United States Patent [19]

Aime et al.

[11] Patent Number: 5,005,671

[45] Date of Patent: Apr. 9, 1991

[54] APPARATUS FOR DAMPING OSCILLATIONS IN ELEVATOR CARS

[75] Inventors: Michel Aime, Maurepas, France; Edmund Sager, Meggen, Switzerland

[73] Assignee: Inventio AG, Switzerland

[21] Appl. No.: 378,658

[22] Filed: Jul. 12, 1989

[30] Foreign Application Priority Data

Jul. 12, 1988 [CH] Switzerland ..... 02652/88

[51] Int. Cl.[5] ..... B66B 9/00

[52] U.S. Cl. ..... 187/1 R; 248/581; 248/603

[58] Field of Search ..... 187/1 R, 95; 248/581, 248/560, 561, 580, 603, 610, 634, 635

[56] References Cited

U.S. PATENT DOCUMENTS

| | | | |
|---|---|---|---|
| 4,113,064 | 9/1978 | Shigeta et al. | 187/1 R |
| 4,428,460 | 1/1984 | Luinstra | 187/1 R |
| 4,660,682 | 4/1987 | Luinstra et al. | 187/1 R |
| 4,713,714 | 12/1982 | Gatti et al. | 248/581 |

FOREIGN PATENT DOCUMENTS

| | | | |
|---|---|---|---|
| 1136467 | 9/1962 | Fed. Rep. of Germany | 187/1 R |
| 1049442 | 12/1953 | France | 187/1 R |
| 1075365 | 6/1967 | United Kingdom . | |
| 1407158 | 9/1975 | United Kingdom . | |

*Primary Examiner*—Robert P. Olszewski

*Assistant Examiner*—Kenneth Noland

*Attorney, Agent, or Firm*—Marshall & Melhorn

[57] ABSTRACT

An apparatus for isolating horizontal shocks, generated in high speed elevators by inaccurately aligned guide rails, from the elevator car body includes spherical shock absorbers for supporting the bottom side of the car body in a car sling and centering elements with cooperating guide pins connected between the top side of the car body and the car sling. The lower portion of the car body can, in the case of horizontal shocks, execute a rolling deflection movement on the spherical shock absorbers to absorb these shocks. This deflection movement takes place against a centering spring tension, which is produced by a centering device attached to the bottom side of the car body and a guide pin extending through a guide sleeve of the centering device which pin is moved by the car body into an inclined position. An elastic filler element produces a centering counterforce on the upper portion of the guide pin. The lower portion of the guide pin extends into a ball shaped body which is supported in a spherical tensioning device. The spherical tensioning device has a clamping and release device for releasing and limiting the deflection movements. The release takes place during the travel of the car and the limiting takes place prior to the end of the trip in order to assure a safe functioning of the door coupling apparatus and of the door unlocking mechanism.

13 Claims, 2 Drawing Sheets

APPARATUS FOR DAMPING OSCILLATIONS IN ELEVATOR CARS

BACKGROUND OF THE INVENTION

The present invention relates to a apparatus for the damping of oscillations in elevator cars and, in particular, to an apparatus for attenuating horizontal shocks in elevator cars.

High speed elevators place high demands on the precision of the guide rail alignment for the elevator cars. An inaccuracy in the alignment, as well as bad rail joints, can cause intermittent and jerky lateral movement of the car body and, in this manner, reduce the ride comfort with respect to vibration and noise. Such lateral movement becomes increasingly noticeable at higher speeds since it is related to the square of the car velocity. It is generally known to provide vibration damping elements of a variety of types and at different points between the body of the car and the car suspension. This type of vibration damping requires a compromise between soft and hard damping, wherein the hard damping reduces the ride comfort and the soft damping can cause high lateral deviation, both with corresponding unpleasant ride consequences.

U.S. Pat. No. 4,660,682 shows an elevator system in which the lower portion of an elevator car is supported for horizontal movement in all directions on roller or sliding guides, and the upper portion is held in an intermediate position by means of damping elements between the car sling and the car The horizontal deviation of the lower portion of the car takes place against the spring tensions centering the car. In addition to the spring tensioning, a mechanical limit centering device is provided which consists of an operating cylinder and linkage.

The action of the mechanical centering device shown in U.S. Pat. No. 4,660,682 can transmit noise and shocks to the car. The deviation of the lower portion of the car corresponds to the movement of a pendulum, so that every point on the lower end of the car moves on a circular path around the center of rotation of the upper end of the car. In turn, this motion has the consequence that, in particular, the peripheral points on the lower end of the car must make a corresponding vertical movement. In view of the rigid support in the vertical direction for sliding and rolling, undesirable effects result, such as for instance one sided lifting or canting of the elevator car. In addition, it is difficult to integrate a load measurement device in this type of car support.

U.S. Pat. No. 4,113,064 describes a similar car mounting device. The mechanical limiting of lateral movement is performed with an electromagnet which is attached to the car support and, on excitation, attracts a rubber supported plate mounted on the body of the car. The resultant frictional connection prevents a further horizontal deviation of the car. However, the required vertical movement compliance is only partially available. This mechanical limiting device makes a noticeable knocking noise and it is not contemplated that the device be actuated during the travel of the car.

SUMMARY OF THE INVENTION

The present invention is based on the problem of creating a device for damping oscillations in an elevator car which device has fewer mechanical parts than prior art devices, works noiselessly and, in addition, offers the highest possible ride comfort at high velocities of car travel. Accordingly, in an elevator system, an elevator car body is supported in a car sling with a damping apparatus attached thereto. The car body is supported at its bottom side on spherical shock absorbers and held in a central position in the elevator shaft at its upper side by centering elements and guide pins. The lower portion of the car body can execute a rolling deflection movement on the shock absorbers to absorb horizontal shocks. This deflection movement is resisted by a centering means attached to the lower side of the car body.

The lower centering means includes a guide pin extending through a guide sleeve which guide pin is moved into an inclined position by the deflected car body. An elastic filler element produces a centering counterforce on the upper portion of the pin. The lower portion of the guide pin extends into a ball shaped body which body is supported in a spherical tensioning means The tensioning means includes a clamping and release device for releasing and limiting the deflection movements of the car body. The release takes place during the travel of the car and the limiting takes place prior to the end of the trip in order to assure a safe functioning of the door coupling apparatus and the door unlocking mechanism.

The advantages of the present invention are:

that at a rolling horizontal displacement of the lower portion of the car, simultaneously the vertical compliance necessary for a pendulum movement is provided;

that by quantitatively regulated actuation of the limiting device, it is possible to achieve a smooth mechanical stabilization of the car, even during the car travel;

that integrated elements of a static load measurement means are incorporated in the supports for the spherical shock absorbers;

that no external stops are necessary for limiting the horizontal deviation of the car; and that the accuracy of the load measurement is not degraded by any frictional effects.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
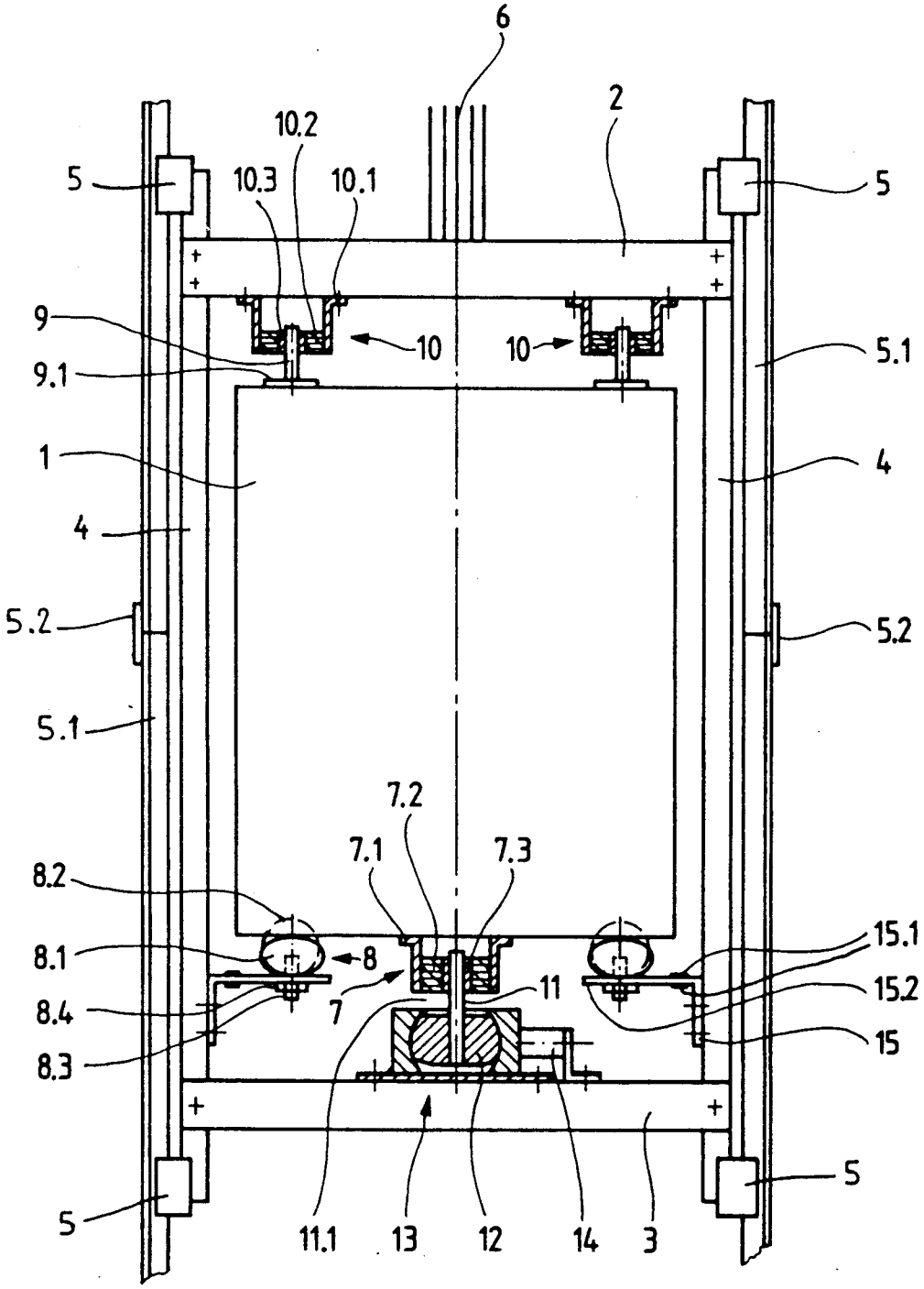
FIG. 1 is a front elevational view of an elevator car incorporating a damping apparatus in accordance with the present invention.

In FIG. 1, there is shown a portion of an elevator system in which a pair of generally vertically extending, spaced apart, parallel side shields 4, and generally horizontally extending spaced apart lower yoke 3 and upper yoke 2 are attached together to form a car sling for supporting an elevator car body 1. The car sling is guided along generally vertically extending guide rails 5.1 by means of guide shoes 5 positioned adjacent the yokes 3 and 4 and is supported by one or more cables 6. A guide rail joint 5.2 connects abutting ends of sections of the guide rails 5.1 together.

The car body 1 is supported in the car sling at its bottom side on four spherical shock absorbers 8 each of which is attached to a horizontal leg 15.2 of an associated supporting angle 15 with bolts 8.3 and nuts 8.4. Sensing elements 15.1 of a static load measurement device are located on the upper and lower surfaces of each the horizontal legs 15.2 and are attached to the leg 15.2 between the shock absorbers 8 and the attachment point of a vertical leg of the angle 15 to the side shield 4. A lower centering means 7 is attached to a bottom side of the car body 1 and consists of an outer casing or shell 7.1, which encircles an elastic filler element 7.2 which, in turn. encircles a guide sleeve 7.3. A spherical tensioning means 13 is attached to an upper side of the lower yoke 3 and includes a clamping and release device 14.

Located in the spherical tensioning means 13 is a ball shaped body 12 with a guide pin 11 protruding upwardly through the center and solidly attached to the same. An upper portion 11.1 of the guide pin 11 extends through a central aperture in the guide sleeve 7.3. A dotted contour 8.2 depicts the shape of the shock absorbers 8 in the unloaded state as a ball, and a solid contour 8.1 shows the shape of the same in the normal, loaded state. Upwardly extending guide pins 9 are attached to plates 9.1 which are mounted on the top side of the car body 1. The guide pins 9 extend through guide sleeves 10.3 of centering elements 10 The sleeves 10.3 are each encircled by a casing 10.1 which is attached to a lower side of the upper yoke 2. Positioned between the casing 10.1 and the guide sleeve 10.3 is an elastic filler element 10.2.

Figure 2:
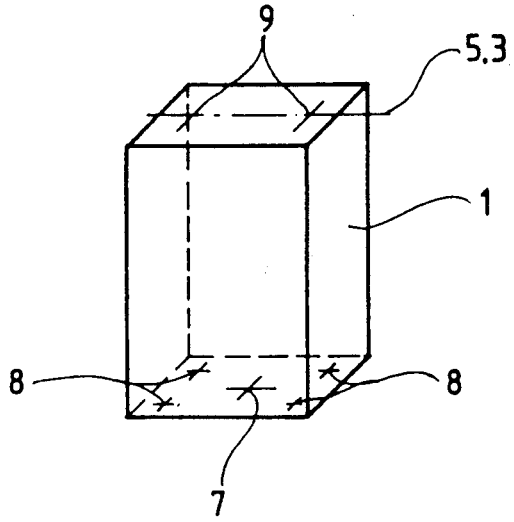
FIG. 2 is a perspective schematic view of the car shown in FIG. 1 indicating the placement of the elements of the present invention.

FIG. 2 illustrates, as an example, the placement of the lower centering means 7, the spherical shock absorbers 8 and the guide pins 9 on the car body 1. The spherical shock absorbers 8 are located under the four corners of the bottom side of the car body 1. The lower centering element 7 is attached centrally to the car bottom and the guide pins 9 are arranged in line on a guide axis 5.3 on the top side of the car.

Figure 3:
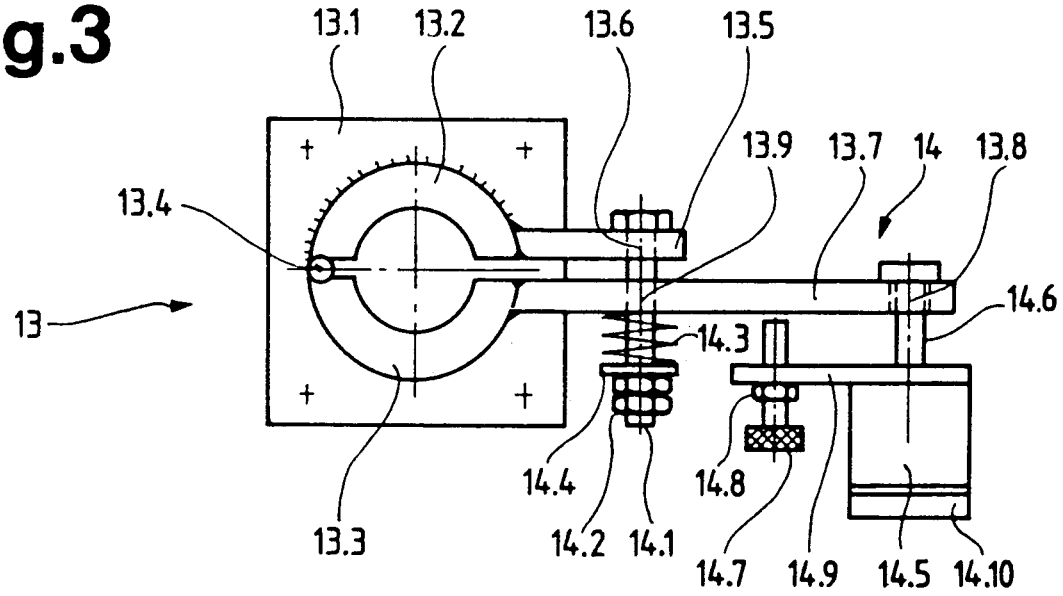
FIG. 3 is a top plan view of the spherical tensioning means shown in FIG. 1.

FIG. 3 shows a top view of the spherical tensioning means 13 with the clamping and release device 14. Located on a base plate 13.1 there is a fixed clamping jaw 13.2 which is solidly attached to the base plate 13.1 and is connected along one edge by a vertically extending hinge 13.4 with a movable clamping jaw 13.3. Attached to the fixed clamping jaw 13.2, opposite the hinge 13.4, is a horizontally extending short arm 13.5 with a horizontally extending aperture 13.6 formed through an outer end thereof. Opposite the hinge 13.4, a horizontally extending long arm 13.7 is attached to the movable clamping jaw 13.3 and has an outer horizontally extending aperture 13.8 and an inner horizontally extending aperture 13.9 formed therein.

The clamping and release device 14 consists of two separate functional groups of elements, one for clamping and one for releasing. The group of elements for releasing acts on the outer end of the long arm 13.7 through a clamping bolt 14.6. The bolt 14.6 has a head which abuts the arm 13.7 and a shaft which extends through the outer aperture 13.8 and is attracted by an electromagnet 14 5 upon excitation thereof. The electromagnet 14.5 is attached to a vertically extending supporting angle 14.10 which is attached to a generally horizontally extending plate (not shown) similar to the base plate 13.1. The opening distance between the arms 13.5 and 13.7 is limited by means of a set screw 14.7 and a stop nut 14.8. The set screw 14.7 extends through a flange plate 14.9, which is attached to the electromagnet 14.5, a distance determined by the nut 14.8 The point of engagement of the end of the set screw 14.7 on the long arm 13.7 is centered between the outer aperture 13.8 and the inner aperture 13.9. Tension is applied to the arms by means of a tension bolt 14.1 which passes through the apertures 13.6 and 13.9 and has a head end which abuts the short arm 13.5. The bolt 14.1 extends through and is prestressed by a tension spring 14.3 compressed between the long arm 13.7 and an apertured disc 14.4 held on the bolt 14.1 by a pair of stop nuts 14.2.

Figure 4:
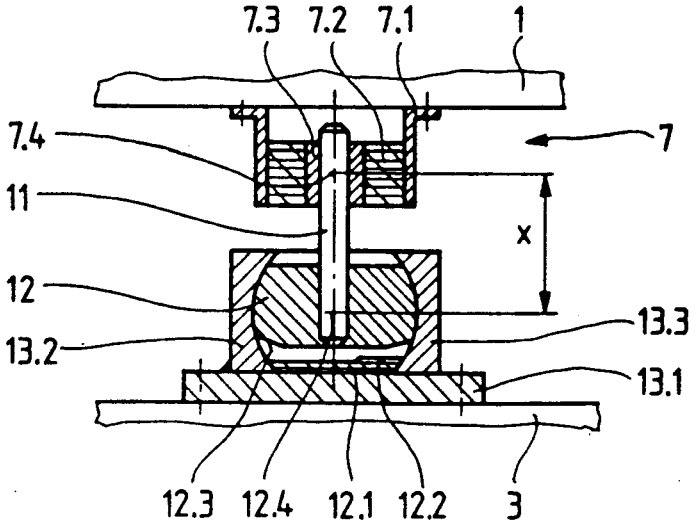
FIG. 4 is an enlarged cross-sectional view of the centering means and the spherical tensioning means shown in FIG. 1.

In FIG. 4, the ball shaped body 12, which is flattened on top and bottom, has a bevel or chamfer 12.3 formed on its lower rim. The upwardly protruding guide pin 11 extends into and is attached to the ball shaped body 12. With the spherical tensioning means 13 in a released position, the pin 11 and the body 12 are free to move around a center point 12.4 on the longitudinal axis of the pin 11 within an available angle of rotation. Designated with "X" is the distance between the point 12.4 and a further point of rotation 7.4 at the center of the lower centering means 7 and also on the longitudinal axis of the pin 11. Resting on the base plate 13.1, between the two clamping jaws 13.2 and 13.3, is a damping or shock absorbing bumper support 12.1 formed of a viscoelastic material. An additional bumper support 12.2, positioned on the support 12.1, can be utilized to reduce the angle of movement for the ball shaped body 12 in a desired direction.

The apparatus described above functions in the following manner:

The car body 1 is supported in the car sling with its bottom side or floor abutting the spherical shock absorbers 8. Vibration bumpers of spherical shape have the property that their force, displacement characteristic is strongly progressive. At a working point chosen for the purpose of illustration, the vertical travel stroke of the car body is, for example, at most two millimeters for a maximum load change. Higher frequency mechanical vibrations (for instance 10 Hz) are still absorbed. The car body 1 is now able to roll on the spherical shock absorbers 8 in all horizontal directions far enough, without the motion being impeded by the bolts 8.3, so as to absorb lateral shocks of known causes with a lateral evading movement in relation to the car side shields 4 and prevent such shocks from reaching the passengers. In order for this horizontal evading movement to take place, the spherical tensioning means 13 is released during car travel by exciting the releasing electromagnet 14.5 The ball shaped body 12 can then move freely in the spherical tensioning means 13. In case of a horizontal evading movement, a resetting spring tension is generated by the transverse pull of the guide pin 11 acting through the lower centering means 7 attached to the bottom side of the car body 1. The guide sleeve 7.3 is pulled transversely and the elastic filler element 7.2 then produces the corresponding counterforce to bring the guide sleeve 7.3 into a vertical position and the car body 1 into a centered position.

While the car body 1, at its lower end, carries out these shock absorbing evading movements during its travel, the upper end of the car is maintained in a definite center position by the two guide pins 9 and the centering elements 10 located in line along the guide axis 5.3. The guide pins 9 can slide in the guide sleeves 10.3 in a vertical direction so that during vertical movement of the car body 1, no additional vertical force is generated as a consequence of a load change or deflection of the lower portion of the car body, In the horizontal direction, the centering elements 10 with the elastic filler elements 10.2 can absorb higher frequency transverse vibrations isolating such vibrations from the car body 1.

Limits must be set for the deviation or deflection motion of the lower portion of the car body 1, because spatial conditions in the elevator shaft, especially the distance to the front wall of the shaft on the entrance side of the car, are limited. Provided for this function is the bumper support 12.1 in the spherical tensioning means 13. The deflection movement of the lower portion of the car body 1 pulls the guide pin 11 and the ball shaped body 12 to an oblique position until the bevel 12.3 rests on the bumper support 12.1. Dependent on the specific surface pressure and the Shore hardness of the bumper support 12.1, the pin 11 and the body 12 then traverse a corresponding bumper path.

Practically, the deflection of the guide pin axis can and should be greater in the direction of the elevator shaft walls than in the direction of the floor opening for two reasons. First, the deflection towards the opening must never equal the value of the door sill air gap and second, the function of the mechanical coupling of the shaft door and the car door must not be jeopardized. In general, the door coupling mechanisms are arranged on the upper half of the car body so that they are limited to only a fraction of the deflection movement, due to the centering elements 10 and the guide pins 9 on the top side of the car body 1. However, the door sill gap is located in the plane of the greatest deflection movement, which movement then must be controlled and limited absolutely, securely and reliably in the direction towards the opening. This limitation is achieved by the additional bumper supports 12.2 in the spherical tensioning means 13 at that point which reduces the deflection distance of the car body 1 towards the floor openings to an acceptable amount. The permitted amount of the deflection distance can be, for instance, ten millimeters where for the other directions of movement fifteen to twenty millimeters would then be permissible.

Natural vibrations of the car body 1 in the self resonant range of, for example, one to one and one half Hz are avoided by the internal damping friction of the elastic filler elements 7.2 and 10.2 and that of the spherical shock absorbers 8. The location and dimensions of the individual components of the apparatus according to the invention are coordinated with the mass of the car, the maximum travel velocity to be attained and the characteristics of the installation site.

As mentioned above, the effects of inaccurate alignment of the guide rails are amplified as the square of the travel velocity. Thus, it follows, that in an elevator installation with, for example, four meters/second nominal velocity. Practically no deflections of the car body 1 will occur at a velocity of one meter/second and that the car body 1 will rest in the neutral center position by the action of the lower centering means 7. Thus, the spherical tensioning means 13 does not enter into action in order to create mechanically stable conditions for the imminent door coupling function at the levelling in at a destination stop. The spherical tensioning means 13 is clamped by the tension spring 14 3 and by switching off the electromagnet 14.5, and it brakes eventual small deflections of the car body 1 to a standstill. By time proportional control of the excitation current of the electromagnet 14.5, the rise of the clamping force takes place likewise time proportionally, which assures a noise and shock free clamping operation. Until the next trip, the car body 1 remains locked against horizontal movements by the spherical tensioning means 13 securely clamped by the spring 14.3.

The elements of a static load measurement device 15.1 operate completely independently from the functions of the damping apparatus according to the present invention. During vertical movements of the car body 1, no vertical forces which can change the load measurement are generated in the sliding guide sleeves 7.3 and 10.3, in the guide pins 9 or in the pin 11. The conversion geometry between the horizontal car movement and that of the bevel 12.3 on the underside of the ball shaped body 12 is given by the distance "X" between the two points of rotation 12.4 and 7.4 as well as the diameter of the ball shaped body 12. Changes of the distance "X" by millimeters due to load changes can then be taken into account.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An apparatus for damping vibrations generated in an elevator car body supported in an elevator car sling, comprising:

at least two spherical shock absorbers adapted to be attached to an elevator car sling for abutting a bottom side of an elevator car body supported by the car sling;

a spherical tensioning means adapted to be attached to the car sling and including a bumper support for limiting the deflection movement of the car body in the car sling and at least one other bumper support attached to said bumper support for further limiting the deflection movement of the car body in the car sling;

a lower centering element adapted to be attached to the bottom side of the car body for generating springy and damped return movement of the car body into a center position in the car sling and coupled to said spherical tensioning means; and centering and damping elements adapted to be attached between a top side of the car body and the car sling.

2. The apparatus according to claim 1 wherein said spherical tensioning means includes a clamping and release device for selectively limiting horizontal movement of the car body in the car sling.

3. The apparatus according to claim 1 including guide pins adapted to be attached to the car body and wherein said centering and damping elements each include a guide sleeve for slidably engaging an associated one of said guide pins.

4. The apparatus according to claim 1 including supporting angles each having one leg attached to said spherical shock absorbers and adapted to be attached at another leg to the car sling and sensing elements of a load measurement device attached to said supporting angles.

5. In an elevator system, comprising:

an elevator car sling adapted to be suspended in an elevator shaft;

an elevator car body supported by said car sling;

at least two spherical shock absorbers attached to said car sling and abutting a bottom side of said car body;

a spherical tensioning means attached to said car sling;

a lower centering element attached to the bottom side of said car body for generating springy and damped return movement of said car body into a center position in said car sling and including an outer casing surrounding an elastic filler element and a guide sleeve attached to and extending through said filler element for retaining one end of a guide pin having its other end retained by said spherical tensioning means; and centering and dampening elements attached between a top side of said car body and said car sling.

6. The elevator system according to claim 5 wherein said spherical tension means includes a clamping and release device for selectively limiting horizontal movement of said car body in said car sling.

7. The elevator system according to claim 5 wherein said spherical tensioning means includes a pair of hingedly connected clamping jaws surrounding a ball shaped body retaining said other end of said guide pin.

8. The elevator system according to claim 5 wherein said spherical tensioning means includes a ball shaped body coupled to said lower centering element by a guide pin, a pair of clamping jaws surrounding said ball shaped body, one of said clamping jaws being moveable with respect to the other one of said clamping jaws, spring means moving said moveable clamping jaw toward said other clamping jaw to clamp said ball shaped body between said clamping jaws, and electromagnetic means which upon actuation moves said moveable clamping jaw away from said other clamping jaw.

9. The elevator system according to claim 5 wherein each of said centering and damping elements includes a guide pin attached to the top side of said car body, a casing attached to said car sling, an elastic filler element located inside said casing, and a guide sleeve attached to and extending through said elastic filler element for retaining an upper end of an associated one of said guide pins.

10. An elevator car comprising:

an elevator car sling adapted to be suspended in and travel up and down in an elevator shaft;

an elevator car body located in said car sling;

a plurality of spherical shock absorbers mounted on supporting angles attached to said car sling, said shock absorbers abutting a bottom side of said car body;

a pair of centering and damping elements attached between a top side of said car body and said car sling for preventing horizontal movement and permitting limited vertical movement of an upper portion of said car body with respect to said car sling;

a lower centering element attached to the bottom side of said car body for generating springy and damped return movement of said car body into a center position in said car sling;

a ball shaped body;

a guide pin extending from said lower centering element and into said ball shaped body; and a spherical tensioning means attached to said car sling and coupled to said lower centering element, and wherein said spherical tensioning means includes a fixed clamping jaw attached to said car sling, a moveable clamping jaw hingedly attached to said fixed clamping jaw, spring means for moving said moveable clamping jaw toward said fixed clamping jaw to clamp said ball shaped body therebetween, and electromagnetic means which when actuated moves said moveable clamping jaw away from said fixed clamping jaw to release said ball shaped body.

11. The elevator car according to claim 10 including means for limiting the movement of said moveable clamping jaw away from said fixed clamping jaw.

12. The elevator car according to claim 10 including sensing elements attached to said supporting angles and adapted to be connected in a load measurement device for the elevator car.

13. An apparatus for damping vibrations generated in an elevator car body supported in an elevator car sling, comprising:

at least two spherical shock absorbers adapted to be attached to an elevator car sling for abutting a bottom side of an elevator car body supported by the car sling;

a spherical tensioning means adapted to be attached to the car sling and including a ball shaped body and a protruding guide pin attached to said ball shaped body;

a lower centering element adapted to be attached to the bottom side of the car body for generating springy and damped return movement of the car body into a center position in the car sling and including a guide sleeve slidably engaging said guide pine for coupling to said spherical tensioning means; and centering and damping elements adapted to be attached between a top side of the car body and the car sling.

* * * * *